United States Patent [19]

Caruso

[11] Patent Number: 4,687,010

[45] **Date of Patent: * Aug. 18, 1987**

[54] HAIR CURLER

[76] Inventor: Richard Caruso, 7801 Montgomery Ave., Elkins Park, Pa. 19117

[ * ] Notice: The portion of the term of this patent subsequent to Jun. 12, 2001 has been disclaimed.

[21] Appl. No.: 511,818

[22] Filed: Jul. 8, 1983

[51] Int. Cl.[4] ..... A45D 2/12

[52] U.S. Cl. ..... 132/33 R

[58] Field of Search ..... 132/33 R, 40, 42, 39; 219/222

[56] References Cited

U.S. PATENT DOCUMENTS

| | | | |
|---|---|---|---|
| Re. 26,766 | 1/1970 | Jorgensen | 219/222 |
| 3,689,736 | 9/1972 | Meyer | 132/33 R |
| 3,700,853 | 10/1972 | Jensen et al. | 219/222 |
| 3,759,271 | 9/1973 | Caruso | 132/33 R |
| 3,766,930 | 10/1973 | Madsen et al. | 132/33 R |
| 3,858,029 | 12/1974 | Walter | 132/33 R |
| 3,858,588 | 1/1975 | Walter et al. | 132/33 R |
| 4,202,360 | 5/1980 | Walter | 132/40 |
| 4,293,760 | 10/1981 | Smal | 132/33 R |
| 4,453,554 | 6/1984 | Caruso | 132/33 R |
| 4,516,011 | 5/1985 | Jeffress et al. | 132/33 R |

*Primary Examiner*—Gene Mancene
*Assistant Examiner*—Cary E. Stone
*Attorney, Agent, or Firm*—Seidel, Gonda, Goldhammer & Abbott

[57] ABSTRACT

The hair curler has a hollow core capable of being electrically heated. A porous sleeve surrounds the core. A passage is provided for enabling steam to enter the core and exit radially through the sleeve. The curler may be heated by steam, by electricity, and by a combination of steam and electricity.

16 Claims, 10 Drawing Figures

FIG. 4
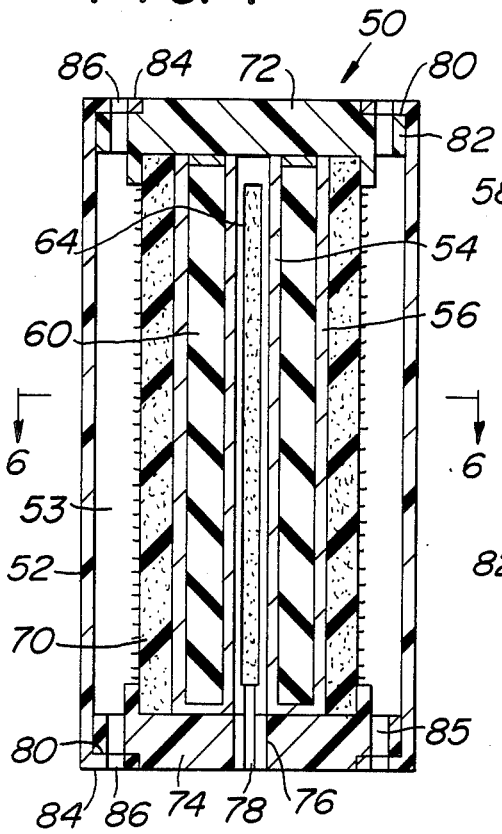
FIG. 5
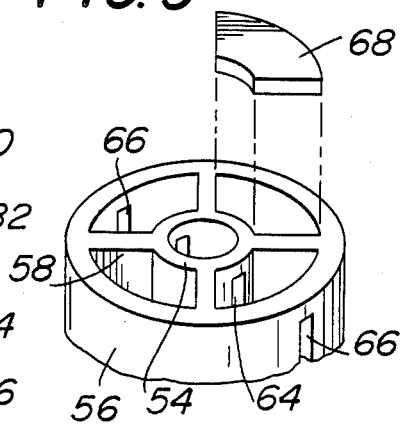
FIG. 6
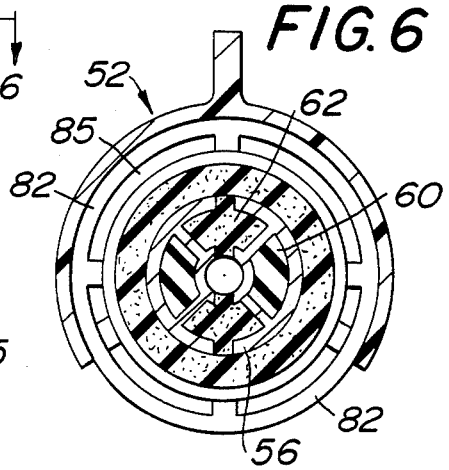
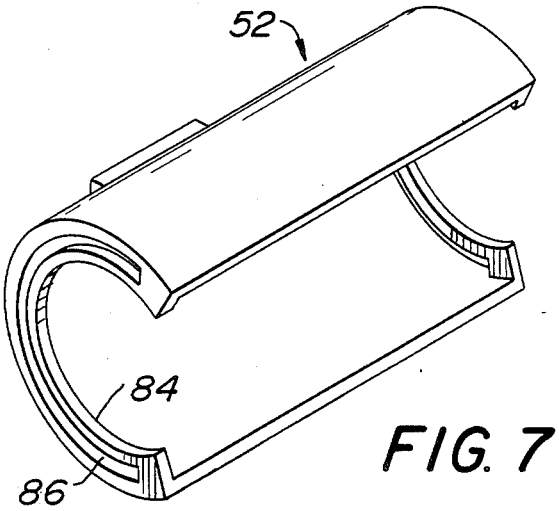
FIG. 7

FIG. 8
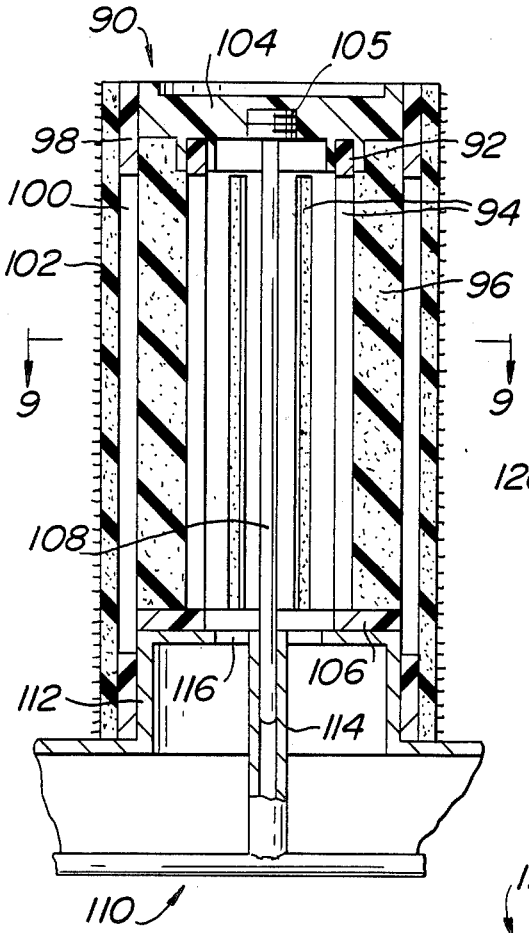
FIG. 9
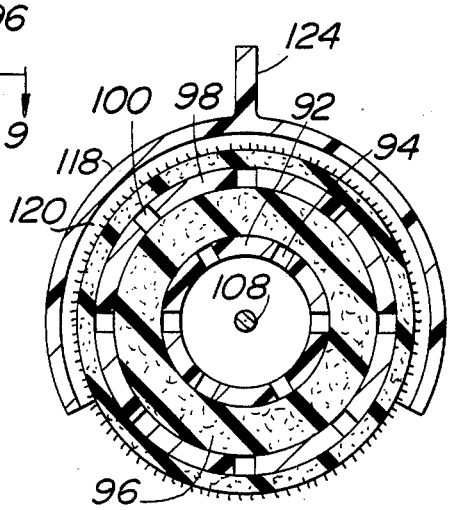
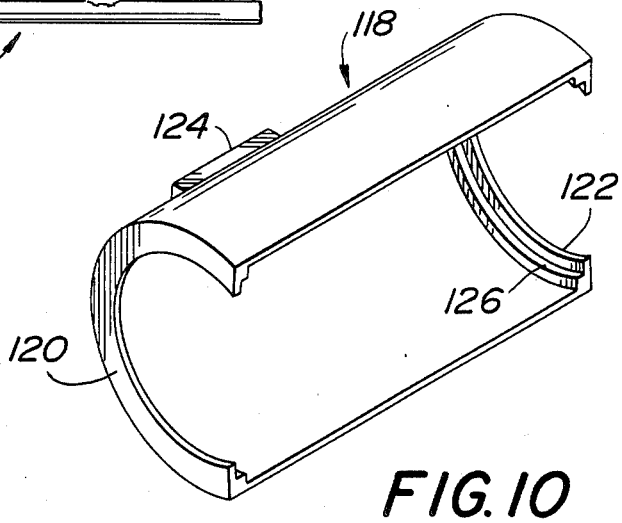
FIG. 10

HAIR CURLER

BACKGROUND OF THE INVENTION

Hair curlers which may be electrically heated are known. Hair curlers which may be steam heated are known. The present invention is directed to recognition that it would be desirous to have a hair curler which may be heated by steam, by electricity, and by a combination of steam and electricity.

SUMMARY OF THE INVENTION

The present invention is directed to a hair curler having a hollow core capable of being electrically heated. A porous sleeve surrounds the core. Passage means are provided for enabling steam to enter the core and exit radially through said sleeve. The passage means has an inlet adjacent one end of the core. The hair curler may be heated by steam, by electricity, and by a combination of steam and electricity.

Various objects and advantages of the hair curler of the present invention will be made clear hereinafter.

For the purpose of illustrating the invention, there is shown in the drawings a form which is presently preferred; it being understood, however, that this invention is not limited to the precise arrangements and instrumentalities shown.

FIG. 4 is a vertical sectional view through a hair curler in accordance with another embodiment of the present invention.

FIG. 5 is a partial perspective view of the core shown in FIG. 4.

FIG. 6 is a sectional view taken along the line 6—6 in FIG. 4.

FIG. 7 is a perspective view of the shield shown in FIG. 4.

FIG. 8 is a vertical sectional view of a hair curler in accordance with another embodiment of the invention mounted on a heater means.

FIG. 9 is a sectional view taken along the line 9—9 in FIG. 8.

FIG. 10 is a perspective view of a shield as shown in FIG. 9.

DETAILED DESCRIPTION

Figure 1:
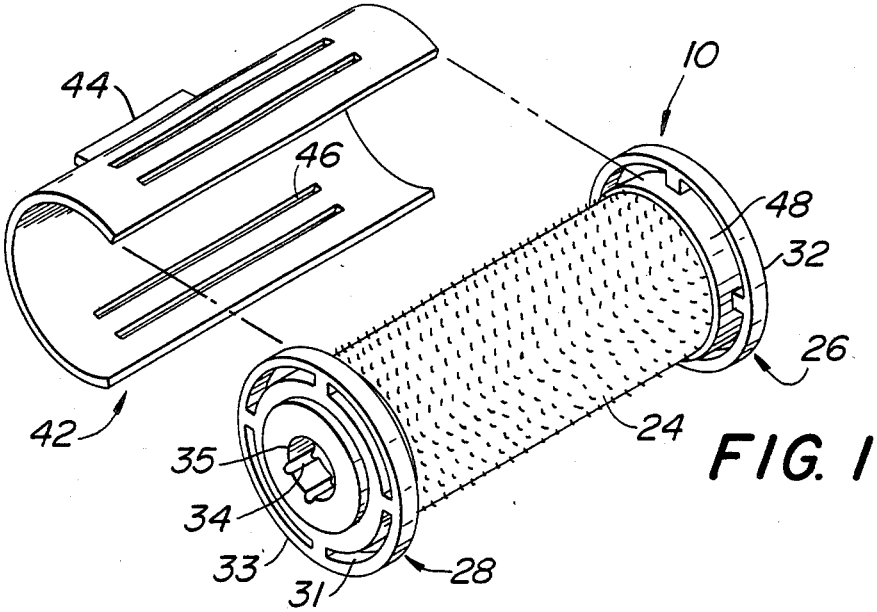
FIG. 1 is an exploded view of a hair curler in accordance with the present invention in association with a shield.
Figure 3:
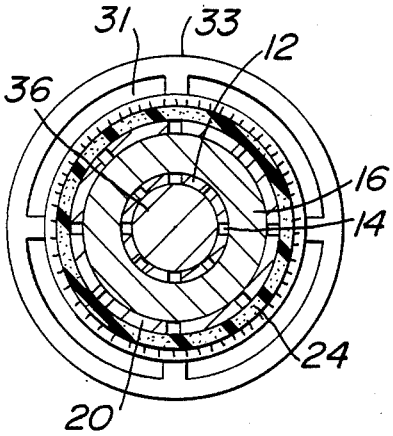
FIG. 3 is a sectional view taken along the line 3—3 in FIG. 1.

Referring to the drawings in detail, wherein like numerals indicate like elements, there is shown in FIG. 1 a hair curler 10 in accordance with the first embodiment of the present invention. Hair curler 10 includes a hollow core 12 having slots 14 at circumferentially disposed locations as shown more clearly in FIG. 3. The core 12 is made from a material so that it may be electrically heated. A plurality of rings 16 are telescoped on the core 12. The rings 16 are made from a material which is a good heat conductor such as aluminum. Between adjacent rings 16, there is provided rings 18 of porous material such as a foam plastic.

A sleeve 20 surrounds the rings 16 and 18 and is in contact with the outer periphery of the rings 16. Sleeve 20 is preferably made from a good heat conducting material. Sleeve 20 is provided with slots 22. A porous sleeve 24 surrounds the sleeve 20. The core 12 is provided with end caps 26 and 28. End cap 26 has a rim 32 connected to the body of the end cap by ribs which define arcuate slots 30. End cap 28 is similarly provided with a rim 33 and arcuate slots 31.

The end cap 28 is provided with an axial hole 35 through which a heating post 36 may extend for contact with the inner peripheral surface of the core 12. The hole 35 has circumferentially disposed slots 34 aligned with the slots 14. Steam from a heater means 40 may exit through port 38, into the slots 34, and the slots 14. Steam would exit through the foam rings 18, through the slots 22, and through the porous sleeve 34.

The heater means 40 may be at a type which has an electrically heated post 36 as well as means for emitting steam through port 38 whereby the curler is heated by a combination of steam and electricity. The heater means 40 may be of a type which only has an electrically heated post such as post 36 for electrically heating the hair curler 10. Alternatively, the hair curler 10 may be used with a heater means which only discharges steam. The versatility of the hair curler 10 its ability to be used with three different types of heater means will be readily apparent to those skilled in the art.

Figure 2:
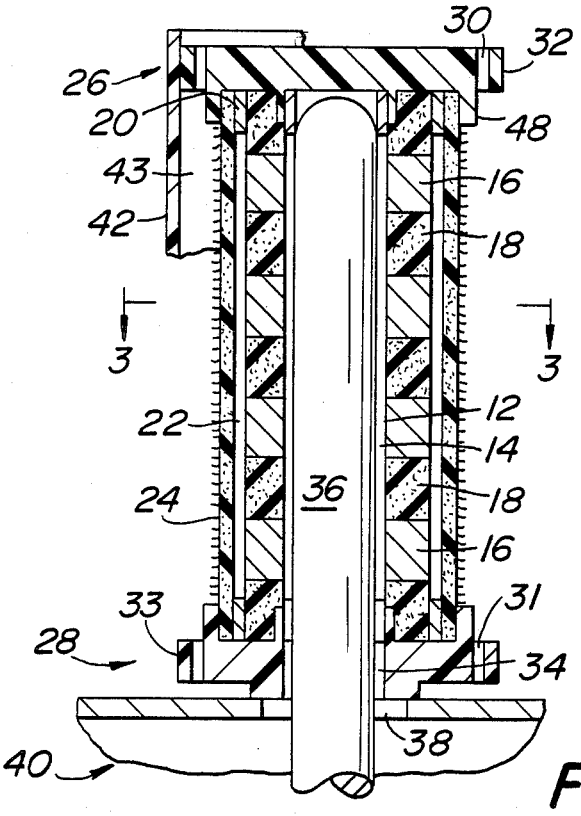
FIG. 2 is a sectional view of the hair curler mounted on a heating means.

The hair curler 10 is preferably provided with a shield 42. Shield 42 is generally C-shaped with the distance between its free edges being slightly less than the diameter of the rims on the end caps 26 and 28. Shield 42 is adapted to overly the rims 32, 33 while extending slightly beyond the rims. See FIG. 2. Shield 42 is preferably provided with a handle 44 and may have longitudinally extending slots 46 to facilitate escape of steam from the chamber 43 between the inner periphery of shield 42 and the outer periphery of porous sleeve 24. Rims 32, 33 act as a spacer to help define chamber 43 which accomodates hair wrapped around the roller when in use.

In FIGS. 4–7, there is illustrated a second embodiment of the present invention wherein the hair curler is designated generally as 50. Hair curler 50 has the same attributes described above in connection with hair curler 10. A shield 52 is provided for use with the hair curler 50. The hair curler 50 includes a hollow central core 54 connected to an outer wall 56 by radially disposed walls 58. See FIG. 5.

The arcuate spaces between adjacent walls 58 are alternately filled with a heat conducting filler 60 or foam plastic 62 at one end of the hair curler. Then the openings at said one end are closed by plugs 68. The inner wall 54 of the core has slots 64 which communicate with the arcuate spaces containing foam plastic 62. A porous sleeve 70 surrounds the outer wall 56 of the core.

The curler 50 is provided with end caps 72, 74. End cap 74 has an inlet 76 to the interior of the hollow core and through which an electrical heating post may extend for contact with the inner wall 54 for electrically heating the curler. The inlet 76 is provided with a grooves 78 which extend onto the inner surface of wall 54 to the slots 64 to faciliate introducing steam into the core for radial discharge through slots 64, foam plastic 62, slots 66, and porous sleeve 70.

Each of the end caps 72, 74 has a peripheral recess 80 on the end face of its rim 82. The shield 52 has a radially disposed wall or flange 84 adapted to be snapped onto the end caps and into the recesses 80. The flanges 84 have an arcuate slot 86 adapted to be coextensive with the arcuate slots in the rims 82. A hair clip may extend through slot 86 and the adjacent slots in the rims 82 to facilitate coupling the shield 52 to the hair curler 50. Rims 82 space shield 52 from sleeve 70 to define chamber 53 adapted to accomodate hair wrapped around sleeve 70 when in use.

Various materials may be utilized as the filler 60 including wax, plastic, or any other heat conductive material. Like curler 10, curler 50 provides for a combination of electrically heating the roller while heating the roller with steam. The steam discharges through the porous sleeve 70 whereby there is a combination of retained heat and moisture. This combination provides for faster curling, a stronger curl, and conditioning of the hair.

In FIGS. 8–10, there is illustrated another embodiment of the present invention wherein the hair curler is designated generally as 90. Hair curler 90 is rimless. A hollow core 92 is provided with circumferentially disposed slots 94. A foam plastic sleeve 96 surrounds the core 92. A sleeve 98 of good heat conducting material surrounds the sleeve 96 and has circumferentially disposed slots 100. A porous sleeve 102 surrounds the sleeve 98.

Opposite ends of the core 92 are in direct heat transfer contact with the sleeve 98 by way of walls 104 and 106. Core 92 and walls 104, 106 may be made integral in one piece from a good heat conducting material such as aluminum or plastic. A suitable good heat conducting plastic operative at the temperatures involved in connection with the hair curler is diallyl phthalate. Other suitable polymeric plastic can be used for core 92 as well as the cores in curlers 10 and 50.

A heating pin 108 has one end removably connected to the wall 104 such as by a threaded member 105, and is concentric with the core 92. It will be noted that pin 108 is longer than the core 92.

The hair curler 90 is adapted to be used with a heater means 110 of the type that has a cylindrical boss 112 provided with a tubular contact 114 for receiving the pin 108 and steam discharge ports 116 radially outwardly of the contact 114. Steam from the heater means 110 may enter the core 92 and discharge radially through the slots 94, foam sleeve 96, slots 100, and porous sleeve 102.

The hair curler 90 may be used with a shield 118 which is generally C-shaped in section and having end walls 120, 122 terminating at a free edge along the longitudinal axis of the hair curler 90. Each wall has a spacer 126 for spacing the inner surface of the shield from the outer surface of sleeve 102 to thereby provide a chamber for accomodating hair wrapped around the hair curler. Shield 118 may be provided with a handle 124.

The heating pin 108 is removable so that the hair curler 90 may be utilized with a standard steam heater means. When the shield 118 is utilized, the entire length of the hair curler 90 is disposed between the end walls 120, 122.

In connection with each of the embodiments of the present invention, the hair roller can be heated quicker when heated by the combination of steam and electricity. In each embodiment, the roller may be made in separate parts coupled together in any well known manner so as to facilitate replacement of sleeves whereby porous sleeves of different porosity may be substituted for one another. Each roller need not be used with the specific shield as disclosed herein. Thus, shields may be interchanged such as by substituting shield 42 for shield 52.

The present invention may be embodied in other specific forms without departing from the spirit or essential attributes thereof and, accordingly, reference should be made to the appended claims, rather than to the foregoing specification, as indicating the scope of the invention.

I claim;

1. A hair culer comprising a hollow core surrounded by a sleeve permeable to steam, said core being capable of being electrically heated and is coupled to an outer wall spaced from an inner wall by a ring of conductive material, the outer and inner walls having passage means for permitting steam to flow radially therethrough, said outer wall being radially inwardly of said sleeve, said sleeve being porous, and passage means for enabling steam of enter said core and exit radially through said sleeve, said passage means having an inlet adjacent one end of the core, whereby the hair culer may be heated by steam and by electrical means.

2. A hair curler in accordance with claim 1 wherein said passage means for enabling steam to enter includes longitudinally extending slots in said core.

3. A hair curler in accordance with claim 1 including a porous layer disposed between said inner and outer walls along the portion of said inner and outer walls containing said passage means.

4. A hair curler in accordance with claim 3 wherein said porous layer is in the form of a ring, said inner and outer walls being coupled together by a ring of heat conducting material coaxial with said first mentioned ring.

5. A hair curler in accordance with claim 3 wherein said porous layer extends axially at diametrically opposite sides of said core in compartments defined by radial walls extending between said inner and outer walls.

6. A hair curler in accordance with claim 1 including a removable heating pin within said core and along the axis thereof.

7. A hair curler in accordance with claim 1 including a removable shield partially embracing an outer periphery of said sleeve, means for spacing an inner periphery of said shield from the outer periphery of said sleeve so as to define a chamber adapted to accomodate hair wrapped around said sleeve.

8. A hair curler in accordance with claim 7 wherein said core has rims at its ends, an outer periphery of the rims engaging the inner periphery of said shield.

9. A hair curler in accordance with claim 8 including a radially inwardly extending wall on the ends of said shield and juxtaposed to end faces of said rims.

10. A hair curler comprising a hollow core capable of being electrically heated, a ring of conductive material being connected to said core, a heater pin connected to said core and disposed along the axis therof, said core having longitudinally extending slots in a wall thereof, a porous sleeve surrounding said portion of said ring, passage means for enabling steam to enter said core and discharge in a radial direction through said slots, said core and said porous sleeve, and means to facilitate removably connecting said pin at one end of a wall of said core.

11. A hair curler comprising a hollow core capable of being electrically heated, a heater pin connected to said core and disposed along the axis thereof, said core having longitudinally extending slots in a wall thereof, a porous sleeve surrounding said portion of said core, passage means for enabling steam to enter said core and discharge in a radial direction through said slots and porous sleeve, and a sleeve having longitudinally extending slots in a wall thereof and being longer in length than said first mentioned slotted wall.

12. A hair curler comprising a hollow core surrounded by an outer wall, said core and wall being connected by a conductive ring, said core being adapted for being electrically heated, a sleeve surrounding said outer wall, passage means for enabling steam to enter said core and exit radially through said sleeve, said passage means having an inlet adjacent one end of the core, said passage means including slots in said core and in said outer wall.

13. A hair curler in accordance with the claim 12 including a porous material in said pasage mean between slots on the core and slots on said outer wall.

14. A hair curler in accordance with claim 12 including a removable shield partially embracing the outer periphery of said sleeve, means for spacing the inner periphery of said shield from the outer periphery of said sleeve so as to define a chamber adapted to accomodate hair wrapped around said sleeve.

15. A hair curler in accordance with claim 14 wherein said core has rims at its ends, the outer peiphery of the rims engaging the inner periphery of said shield.

16. A hair curler in accordance with claim 15 including a radially inwardly extending wall on the ends of said shield and juxtaposed to end faces of said rims.

* * * * *